United States Patent [19]

Wilhere

[11] 3,955,341

[45] May 11, 1976

[54] APPARATUS FOR SCREWING CAPS ON CONTAINERS

[75] Inventor: Charles V. Wilhere, Pittsburgh, Pa.

[73] Assignee: Horix Manufacturing Company, Pittsburgh, Pa.

[22] Filed: Oct. 14, 1975

[21] Appl. No.: 622,391

[52] U.S. Cl. ..... 53/331.5; 53/317; 53/367

[51] Int. Cl.[2] ..... B67B 1/06; B65B 7/28

[58] Field of Search ..... 53/331.5, 317, 306, 53/362, 367, 368

[56] References Cited

UNITED STATES PATENTS

| | | | |
|---|---|---|---|
| 2,884,751 | 5/1959 | Bjering | 53/317 |
| 3,405,499 | 10/1968 | Dexter | 53/331.5 |
| 3,491,516 | 1/1970 | Bergeron | 53/317 |

*Primary Examiner*—Travis S. McGehee
*Assistant Examiner*—Horace M. Culver
*Attorney, Agent, or Firm*—Brown, Murray, Flick & Peckham

[57] ABSTRACT

A housing that is continuously rotatable on a vertical axis has an opening in its bottom and contains a central vertical shaft rotatable a limited number of degrees relative to the housing. This shaft is connected through the housing opening with a chuck that contains means for gripping a screw cap to screw it onto a container. Valve means connect a source of air pressure with the gripping means to cause such means to grip a screw cap. Secured to the housing is a valve member provided with a bleed passage through it, the inlet of which is connected with the air pressure source and the outlet of which normally is closed by a closure member. Projecting from the side of the shaft is a torque arm that is pressed by compressible means carried by the housing to cause stop means projecting from the side of the shaft to move the closure member away from the bleed passage a certain distance. When the torque applied by the gripping means to the screw cap becomes sufficient to compress said compressible means so that the chuck substantially stops rotating, the valve means is shifted by air pressure responsive means to release air pressure from the gripping means. The pressure responsive means is connected with the air source and the bleed passage inlet for actuating the pressure responsive means when the valve member moves away from the stop means as the screw cap substantially stops rotation of the torque arm. The apparatus includes a flexible connection that permits application of screw caps to containers that are eccentric to the axis of rotation of the housing.

10 Claims, 9 Drawing Figures

APPARATUS FOR SCREWING CAPS ON CONTAINERS

In U.S. Pat. No. 3,405,499 apparatus is disclosed for screwing caps on containers. The apparatus includes means for limiting the torque applied to the caps so that all caps will be tightened substantially the same desired amount. It is the purpose of the present invention to improve upon the apparatus shown in that patent. Accordingly, it is among the objects of this invention to provide such apparatus which releases caps faster upon the torque limit being reached, which eliminates side-loading on the main valve stem with its attendant friction and possibility of sticking or jamming, and which permits the application of caps to containers that are eccentric relative to the axis of rotation of the apparatus.

The preferred embodiment of the invention is illustrated in the accompanying drawings, in which FIG. 1 in a plan view.

Figure 2:
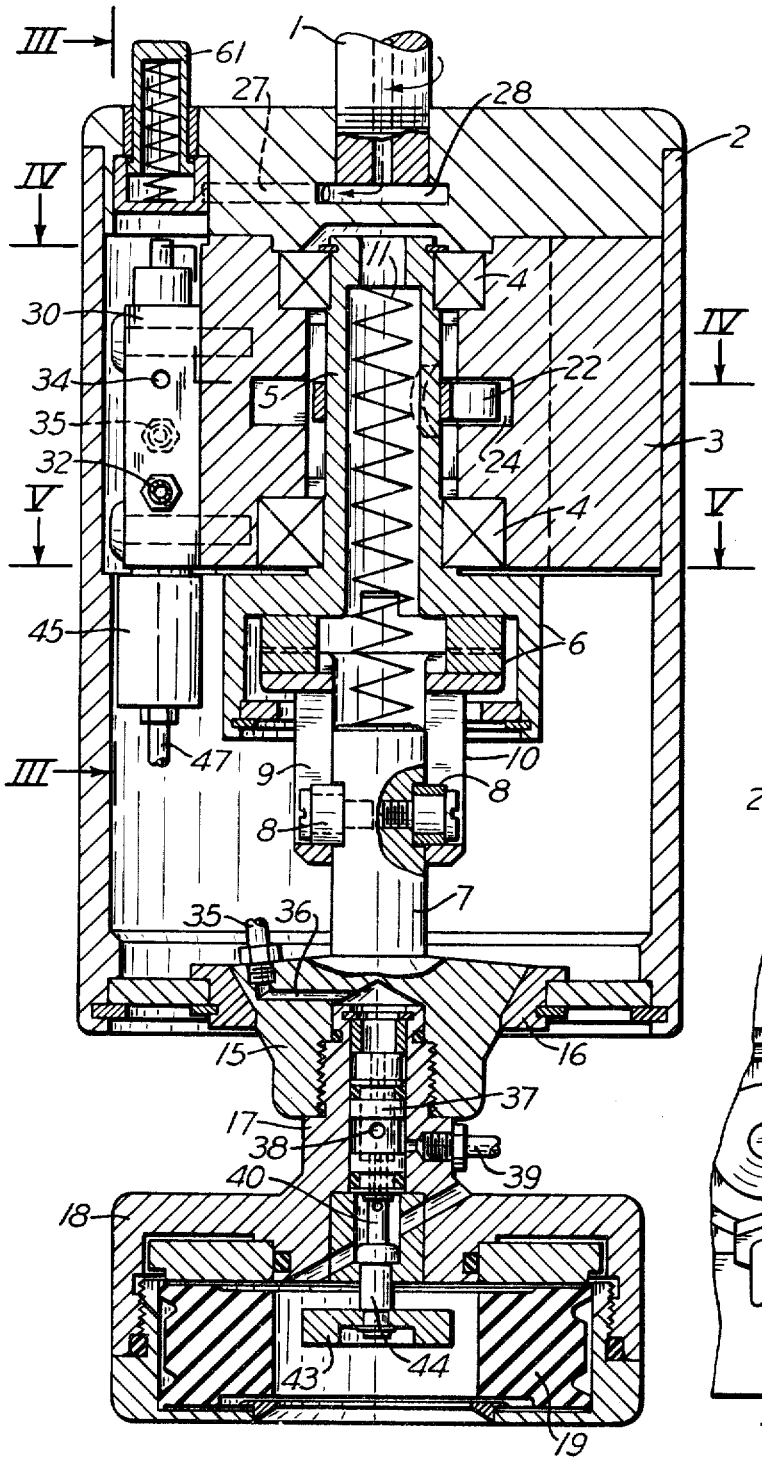
FIG. 2 is a vertical section taken on the line II—II of FIG. 1.
Figure 6:
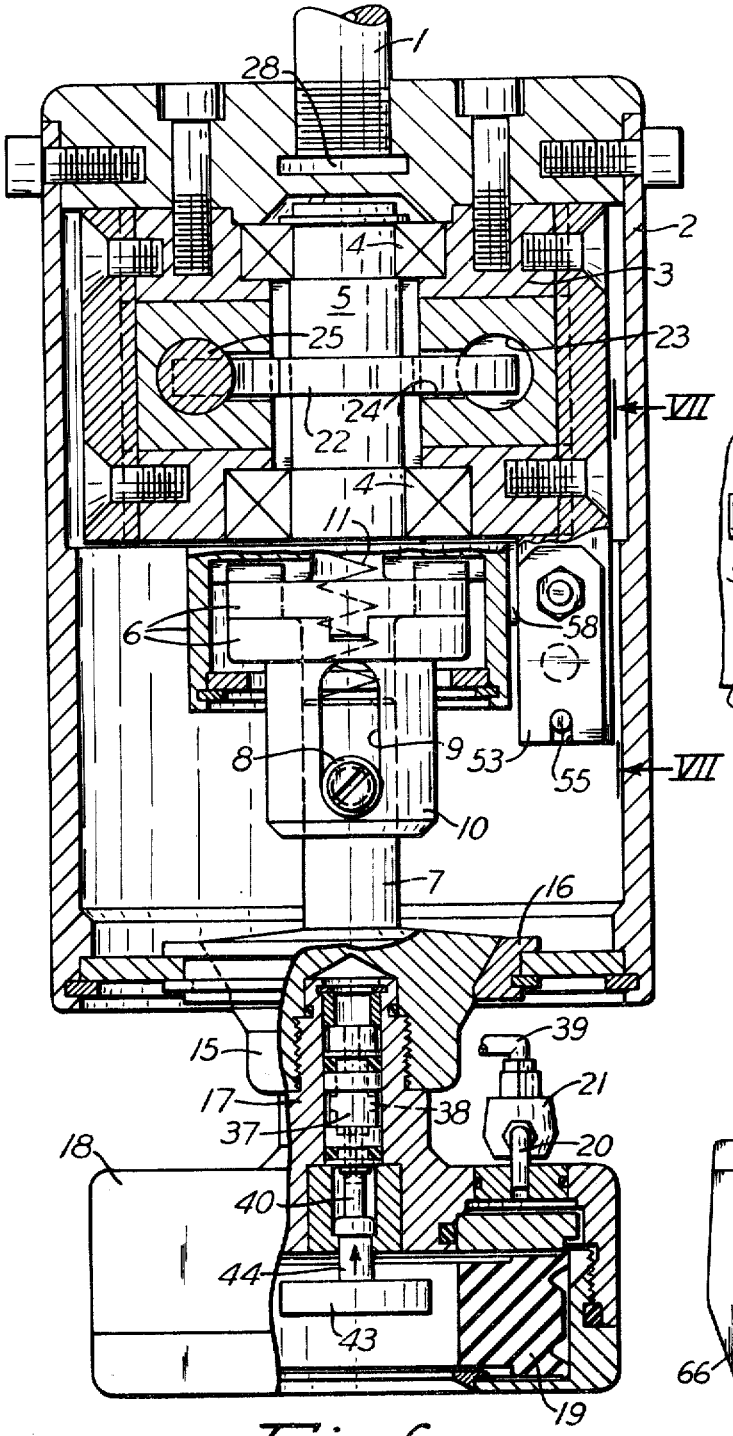
FIG. 6 is a vertical section taken on the line VI—VI of FIG. 1.

The gripping apparatus disclosed herein can be used with a capping machine having a vertically movable, continuously rotating spindle. Such a machine is shown, for example, in my U.S. Pat. No. 3,309,838. Referring to the drawings herein, rigidly mounted on the lower end of the hollow rotating spindle 1 is a cylindrical housing 2 that has a central opening in its bottom. The spindle may be periodically lowered and raised in the manner disclosed in the patent just mentioned or, alternatively, the container that is to be capped can be raised and lowered. Suspended from the top of housing 2 as shown in FIGS. 2 and 6, is a block 3 provided with a central vertical passage, in the upper and lower ends of which bearings 4 are mounted that support and position the hollow upper section 5 of a central vertical shaft that also includes a flexible coupling 6 connecting the hollow section to a lower stem 7. The stem is slidable vertically in the lower part of the coupling, where it is held by bushings 8 attached to opposite sides of the stem and movable up and down in diametrically opposite vertical slots 9 in the coupling sleeve 10. The stem 7 is pressed downwardly by a coil spring 11 compressed between its upper end and a shoulder at the upper end of the hollow section.

The lower end of the central shaft is secured to the top of a plug 15, the upper portion of which is tapered downwardly and normally seats in a downwardly tapered disc 16 framing the opening in the bottom of housing 2. The plug is provided with an upwardly extending central bore, in which the hollow hub 17 of a chuck 18 is rigidly mounted. The chuck is provided in its bottom with a socket, in which there is means for gripping a screw cap to be applied to a container, such as a bottle or can. Preferably, the gripping means is a solid flexible ring 19 made of rubber or the like. The ring can be contracted, to grip an encircled cap, by air under pressure delivered to its outer surface in a space encircling the ring between it and the encircling chuck. This space receives air through a tube 20 from valve 21 (FIG. 6) that will be described later, mounted above the chuck.

Figure 1:
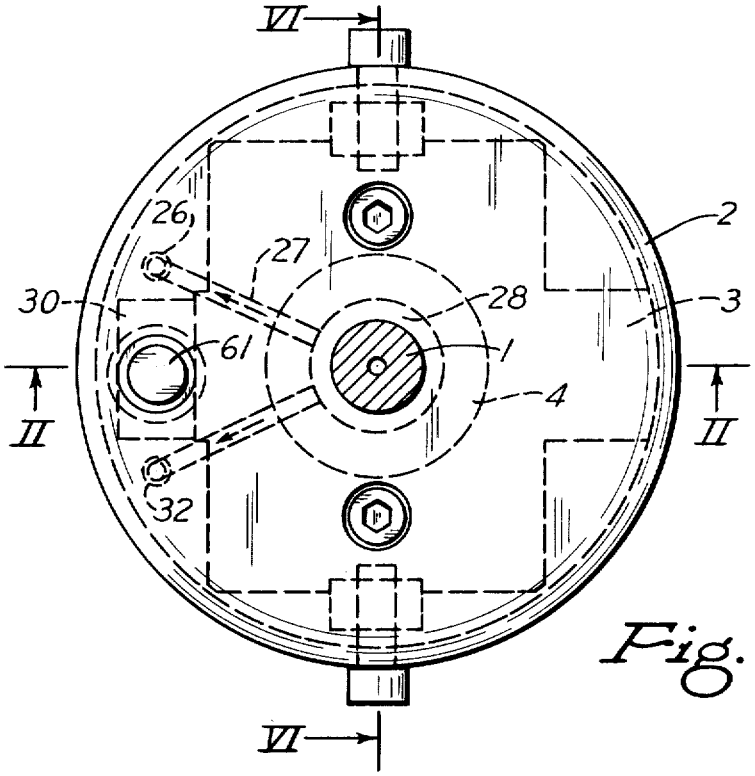
Figure 4:
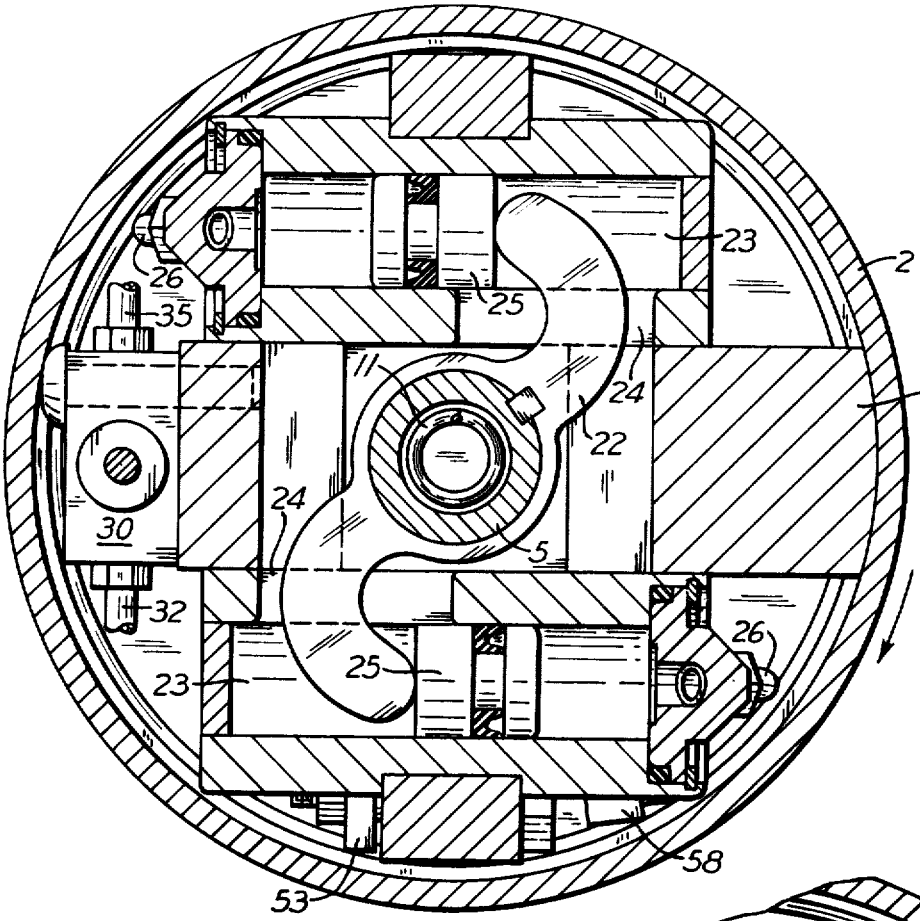
FIGS. 4 and 5 are enlarged horizontal sections taken on the lines IV—IV and V—V, respectively, of FIG. 2.

Since the central shaft inside housing 2 is rotatable therein, means have to be provided to operatively connect the rotating housing with the shaft in order for the housing to rotate the shaft with it. Such means, as shown in FIGS. 2, 4 and 6, include a torque arm 22 rigidly mounted on the hollow upper section 5 of the shaft and extending laterally away from it, preferably in opposite directions. Pressing against the ends of the arm to turn it relative to the housing a few degrees in the same direction the housing is rotating are compressible means carried by the housing. Such means may be springs, for example, but for adjustment purposes air pressure cylinders and pistons are preferred. The parallel cylinders 23 are formed in members rigidly mounted in recesses in block 3 at opposite sides of the central shaft. The ends of the arms extend into the front part of the cylinders through slots 24 in their sides. Disposed in the cylinders between their rear ends and the ends of the arms are the pistons 25. They are held against the ends of the arms by air pressure delivered to the rear ends of the cylinders through tubes 26 (FIG. 4) connected with the outer end of a passage 27 in the top of the housing, as shown in FIG. 1. The inner end of this passage opens into chamber 28 beneath shaft 1, through which air is delivered from a suitable source of compressed air. As the housing rotates, the pistons carried by it and pressing against the torque arm cause the central shaft to rotate with the housing.

Bolted to block 3 inside housing 2 for rotation with it is a main valve 30, with an inlet 31 that may be connected by a tube 32 with the same source of air pressure as cylinders 23. The valve also has a combined inlet and outlet 33 and an exhaust port 34. When the slide inside the valve connects the inlet with the inlet-outlet port, air under pressure is delivered through a flexible tube 35 to a passage 36 in plug 15. The outlet of this passage opens into the top of a commercial slide valve 37 in chuck hub 17. This valve has an inlet-outlet port 38 connected by a tube 39 to valve 21 on the chuck. Valve 37 also has a hollow stem 40 projecting from its lower end. When the stem is in its lower position as shown, the valve inlet is closed and port 38 communicates with the hollow stem and the atmosphere. While housing 2 and the chuck are moving downwardly, a button 43 on the lower end of a plunger 44 engages and is stopped by a screw cap as the chuck continues to move down. This raises stem 40 in the valve to connect the valve inlet with port 38 and to cut off that port from the stem, so air is delivered to valve 21 and gripping ring 19 is contracted to tightly grip the cap. The housing then raises the chuck and cap ready to be moved down again to apply the cap to a container.

Figure 9:
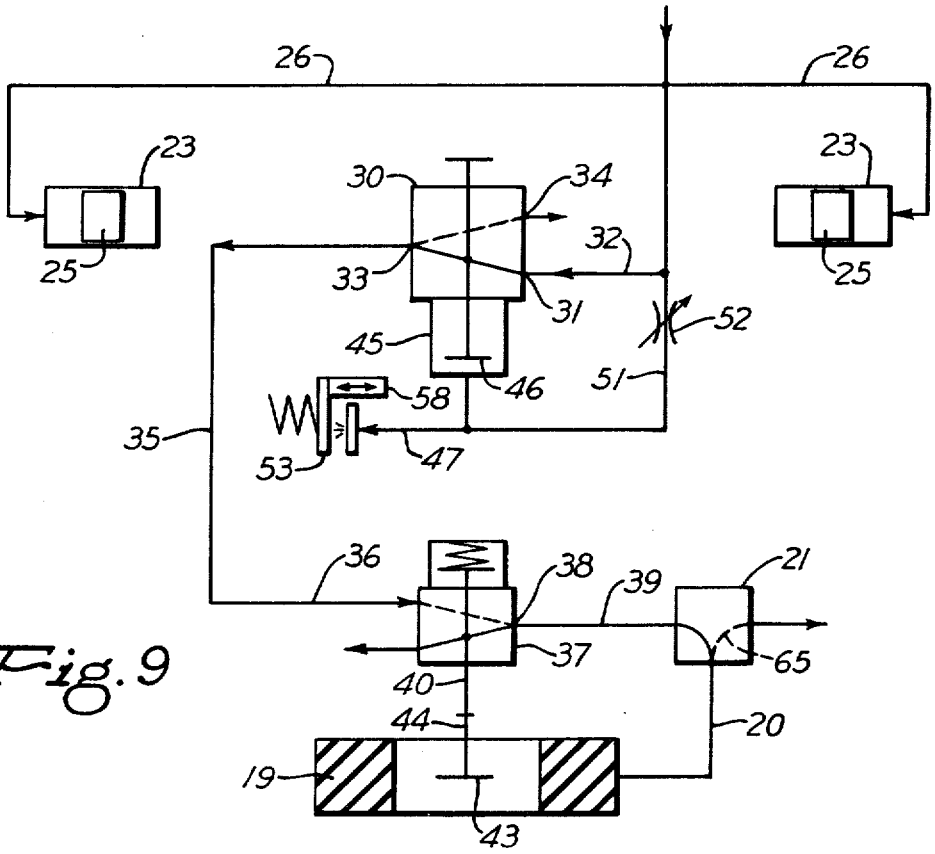
FIG. 9 is a diagram of the pneumatic circuit.
Figure 3:
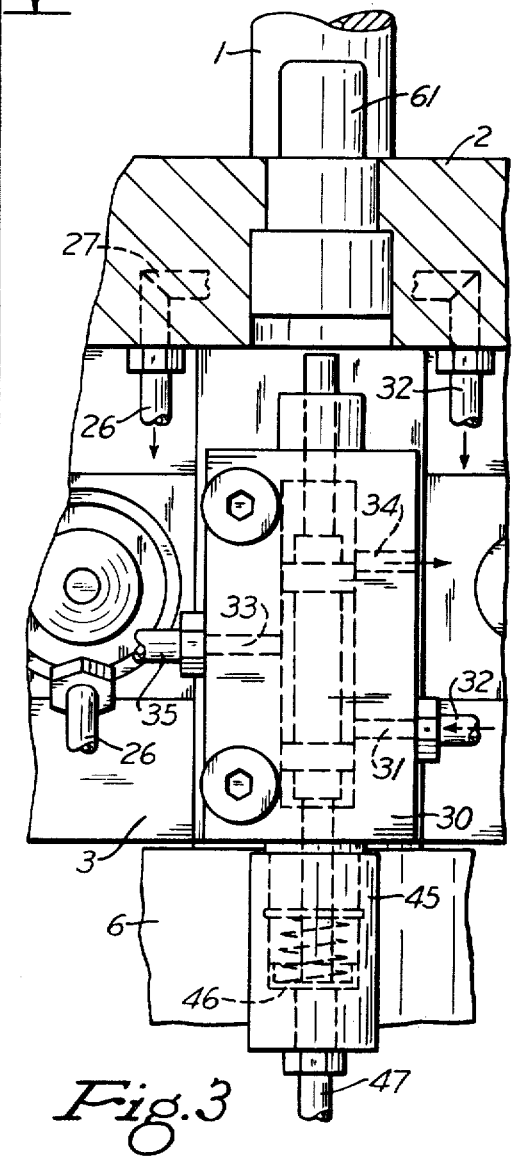
FIG. 3 is an enlarged fragmentary vertical section taken on the line III—III of FIG. 2.
Figure 7:
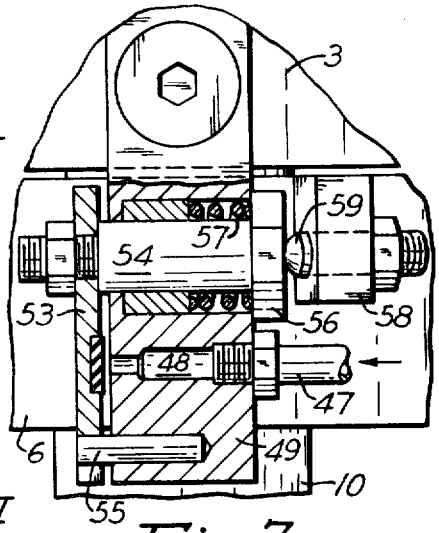
FIG. 7 is an enlarged vertical section taken on the line VII—VII of FIG. 6.

To shift the main valve in order to connect its inlet-outlet port 33 with its exhaust port 34, there is a pilot attached to the bottom of the valve. As shown in FIG. 3, the pilot is in the form of a cylinder 45 that contains a piston 46 that is raised when air pressure is admitted below it, whereby to raise the valve member in the main valve. As shown in FIG. 7, the inlet to the pilot is connected by a tube 47 to the inlet of a bleed passage 48 through a valve member 49 rigidly connected to block 3 inside housing 2 beside the flexible coupling. This passage also is connected by a tube 51 and a variable restrictor 52 (FIG. 9) to the main air supply. The outlet of the bleed passage normally is closed by a closure member, which may include a vertical plate 53 suspended from a pin 54 that extends slidably through the valve member. The lower end of the plate is provided with a notch that fits over a guide pin 55 projecting from the valve member. The upper pin 54 has a head 56 that normally is spaced from the valve member by a coil spring 57 encircling the pin.

Figure 5:
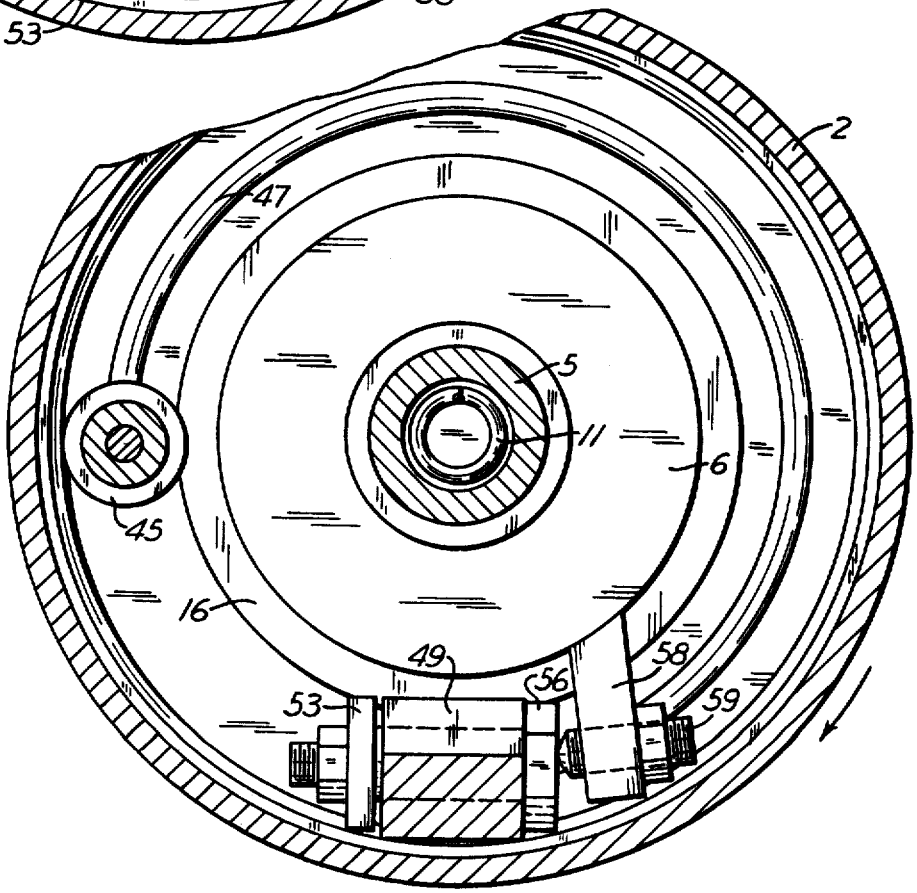

When the bleed passage is closed, air pressure is delivered to the pilot valve to raise the piston therein and thereby connect the inlet-outlet port of the main valve with exhaust. However, when this apparatus is in use and pistons 25 are pressing against the opposite ends of torque arm 22, as shown in FIG. 4, the torque arm rotates the central shaft in the housing a few degrees until stop means projecting from the side of flexible coupling 6 moves pin 54 forward in the valve member and thereby opens the outlet of the bleed passage as shown in FIGS. 5 and 7. Engagement of pin head 56 with valve member 49 also stops further rotation of the shaft relative to the housing. The main air supply and the lower end of the pilot are thereby connected through the bleed passage with the atmosphere. The stop means just referred to may consist of a lug 58 projecting from the central shaft, with an adjustable screw 59 mounted in the outer end of the lug for engaging the head of pin 54, as shown in FIGS. 5 and 7.

After the gripping ring in the chuck has gripped a screw cap in the manner described previously and as the rotating chuck is moved down again to screw the cap onto an underlying container, a point will be reached at which the torque required to screw the cap onto the container more tightly will overcome or exceed the air pressure in cylinders 23, so that the torque arm will substantially stop moving as the cylinders move forward on pistons 25. At the same time, the stop lug 58 projecting from the central shaft likewise substantially stops rotating, with the result that the bleed valve member 49 moves forward away from stop screw 59 as the coil spring holds pin 54 against the screw and thereby permits the outlet of the bleed passage to be closed by closure plate 53. This causes air pressure to immediately build up in tube 47 leading to the pilot and to raise the piston therein to shift the main valve so that the air pressure in the line connecting it with the chuck valve and quick-exhaust valve 21 will be reduced. The moment this occurs, the reduction of air pressure at the quick-exhaust valve causes that valve to release the air pressure from behind the gripping ring directly to the atmosphere, whereupon the gripper ring expands and releases the screw cap. Then, housing 2 is raised, which permits valve stem 44 in the chuck valve to descend and connect that valve with exhaust, and also causes a push button 61 projecting from the top of the housing to engage the bottom of a plate to push the movable valve member in the main valve 30 down to reset that valve. Now that the central shaft in housing 2 is again free to be turned a few degrees by the torque arm and pistons 25, the capping cycle is repeated with the next screw cap and container.

Figure 8:
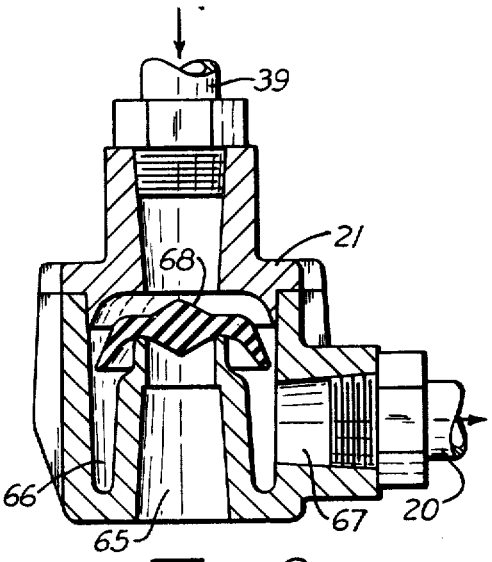
FIG. 8 is an enlarged vertical section through the quick-exhaust valve.

The construction of the quick-exhaust valve is shown in FIG. 8. It contains a vertical exhaust passage 65, the upper end of which is disposed in a chamber 66 and is spaced below the top of the chamber. The wall of the exhaust passage is spaced from the side wall of the chamber, which is provided with an opening 67 connected to tube 20. Normally seated on the upper end of the exhaust passage wall and closing the exhaust port is a floating closure cap 68 that has a recessed bottom with a downwardly flaring side wall spaced from the passage wall. As long as there is air pressure in tube 37, the cap is held on its seat by air pressure and air can flow through the valve from tube 37 to tube 20. However, the moment air pressure in tube 37 is reduced by shifting main valve 30 to exhaust, the greater pressure in tube 20 and behind the gripper ring forces the closure cap up off the exhaust port and against the top of chamber 66, whereby tube 20 is immediately connected through the short exhaust passage with the atmosphere. Since the distance the air has to flow from the chuck to the atmosphere is very short, the gripper ring expands more quickly than heretofore, and therefore releases a screw cap more quickly, thereby permitting faster application of caps.

Another advantage of this machine is that the flexible connection 6 allows caps to be applied to containers that are not in exact axial alignment with the axis of rotation of housing 2. Thus, as a cap is pressed down on a container as the bottom of the housing moves down away from tapered plug 15, due to compression of spring 11, the flexible coupling permits the plug to move sideways in all directions if the container is eccentric to the axis of rotation of the housing.

Finally in U.S. Pat. No. 3,405,499, air pressure presses pin 43, which is an extension of valve stem 44, against cam 41. This can cause sideloading on the valve stem with its attendant friction and tendency to stick or jam. In the present invention, on the other hand, there is no such possibility because the comparable valve 30 is pilot operated with no such sideloading.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. Apparatus for applying a screw cap to a container, comprising a housing continuously rotatable on a vertical axis and having an opening in its bottom, a central vertical shaft in the housing rotatable in opposite directions a limited number of degrees relative to the housing, a chuck below the housing, means connecting the chuck with the shaft for rotation therewith, air pressure actuated gripping means in the chuck for gripping a screw cap, valve means for connecting a source of air pressure with said gripping means for actuation thereof, a valve member secured to said housing and provided with a bleed passage therethrough, means connecting the inlet of said passage with said air source, a closure member normally closing the outlet of the bleed passage, stop means projecting from the side of said shaft, a torque arm rigidly connected to said shaft and projecting from the side of it, compressible means carried by said housing and pressing against said arm to turn it and said shaft with the housing and to cause said stop means to hold said closure away from said bleed passage, air pressure responsive means for shifting said valve means to release air pressure from said gripping means when the torque applied by the gripping means to the screw cap compresses said compressible means so that the chuck substantially stops rotating, and conduit means connecting said pressure responsive means with said air source and said bleed passage inlet for actuating the pressure responsive means when said valve member moves away from said stop means and closes said passage as said torque compresses said compressible means, whereby said gripping means will be released from the screw cap.

2. Apparatus according to claim 1, including a pin slidably mounted in said valve member and having one end secured to said closure member and having an opposite end projecting from said valve member toward said stop means, whereby said stop means can push the pin forward in the valve member to push the closure member away from said bleed passage, and a spring for moving the pin in the opposite direction to close the bleed passage when the valve member moves away from the stop means.

3. Apparatus according to claim 1, in which said air pressure responsive means for releasing air pressure from said gripping means include a cylinder, a piston therein, and a valve-shifting member actuated in one direction by said piston when said bleed passage is closed for shifting said valve means.

4. Apparatus according to claim 3, including means for moving said valve-shifting member in the opposite direction to reset said valve means after a screw cap has been released from said gripping means.

5. Apparatus according to claim 1, in which said compressible means include an air pressure cylinder and a piston therein engaging said torque arm, and means connecting said cylinder with said air pressure source.

6. Apparatus according to claim 1, including a variable restrictor in said conduit means between said air pressure source and said bleed passage inlet.

7. Apparatus according to claim 1, in whih said valve means include a main valve provided with an inlet and an inlet-outlet port and an exhaust port and a movable valve member normally connecting said inlet with the inlet-outlet port, a chuck valve provided with an inlet and an inlet-outlet port and an exhaust port and a movable valve member normally connecting the inlet-outlet port with the exhaust port, a conduit connecting the inlet-outlet port of the main valve with said inlet of the chuck valve, and means for conducting air between the inlet-outlet port of the chuck valve and said gripping means, said apparatus including means actuated by engagement with a screw cap for shifting said valve member in the chuck valve to connect its inlet with its inlet-outlet port, and said air pressure responsive means being connected with said movable valve member of the main valve to connect its inlet-outlet port with its exhaust port.

8. Apparatus according to claim 1, in which said valve means include a main valve provided with an inlet and a inlet-outlet port and an exhaust port and a movable valve member normally connecting said inlet with the inlet-outlet port, means for conducting air between the inlet-outlet port of the main valve and said gripping means, said air pressure responsive means being connected with said movable valve member to connect its inlet-outlet port with its exhaust port, and a quick exhaust valve in said air conducting means having an air passage therethrough and an exhaust port connected with the passage, said quick-exhaust valve containing a floating valve closure closing the exhaust port while air pressure is applied to said gripping means through said passage, said closure being formed to be moved by air pressure between the exhaust valve and gripping means to open the exhaust port of the exhaust valve when the inlet-outlet port of said main valve is connected with the main valve exhaust port.

9. Apparatus according to claim 1, in which said central vertical shaft is formed from separate upper and lower sections connected by a flexible coupling, and the lower section of the shaft is movable toward and away from said upper section.

10. Apparatus according to claim 9, in which said means connecting the chuck with the shaft includes a member provided with a downwardly tapered surface, said housing having a bottom wall provided with a downwardly tapered central opening forming a seat for said tapered surface, whereby when said member is moved vertically off said seat said member is free to move laterally.

* * * * *